US007325882B2

(12) United States Patent
Sugden et al.

(10) Patent No.: US 7,325,882 B2
(45) Date of Patent: Feb. 5, 2008

(54) ROCK CUTTING MACHINE

(75) Inventors: David Burnet Sugden, Kingston Beach (AU); Shivakumar Karekal, Indooroopilly (AU); Paul Camavas, Indooroopilly (AU)

(73) Assignee: Odyssey Technology Pty Ltd, Indooroopilly (AU)

( * ) Notice: Subject to any disclaimer, the term of this patent is extended or adjusted under 35 U.S.C. 154(b) by 0 days.

(21) Appl. No.: 10/512,192

(22) PCT Filed: Apr. 22, 2003

(86) PCT No.: PCT/AU03/00474

§ 371 (c)(1),
(2), (4) Date: Oct. 22, 2004

(87) PCT Pub. No.: WO03/089761

PCT Pub. Date: Oct. 30, 2003

(65) Prior Publication Data

US 2005/0200192 A1 Sep. 15, 2005

(30) Foreign Application Priority Data

Apr. 22, 2002 (AU) ..... PS1869

(51) Int. Cl.
*E21C 25/16* (2006.01)

(52) U.S. Cl. ..... 299/75; 299/76

(58) Field of Classification Search ..... 299/75, 299/74, 73, 72
See application file for complete search history.

(56) References Cited

U.S. PATENT DOCUMENTS

| | | | | |
|---|---|---|---|---|
| 1,634,322 A | | 7/1927 | Dornes, Jr. | |
| 2,336,335 A | | 12/1943 | Zublin | |
| 3,429,390 A | | 2/1969 | Bennett | |
| 3,663,054 A | | 5/1972 | Dubois | |
| 4,005,905 A | | 2/1977 | Dubois | |
| 4,096,917 A | | 6/1978 | Harris | |
| 4,168,755 A | | 9/1979 | Willis | |
| 4,169,629 A | * | 10/1979 | Legrand | 299/61 |
| 4,245,939 A | | 1/1981 | Sear | |
| 4,261,425 A | | 4/1981 | Bodine | |

(Continued)

FOREIGN PATENT DOCUMENTS

AU 18912/70 2/1972

(Continued)

OTHER PUBLICATIONS

Derwent abstract for DE3313435A, Derwent information Ltd. 1984.*

(Continued)

*Primary Examiner*—John Kreck
(74) *Attorney, Agent, or Firm*—Nixon & Vanderhye P.C.

(57) ABSTRACT

A rock cutting machine including a boom rotatably mounted at a proximal end to a chassis adapted to be placed adjacent a rock face to be cut. The boom extends from the chassis to a distal end adjacent the rock face. A longitudinal boom axis extends between the proximal and the distal ends of the boom and a cutting device is pivotally mounted about a pivot axis adjacent the distal end of the boom. The pivot axis enables wrist movement about the pivot axis by a drive mechanism and is offset from the longitudinal axis of the cutting device.

17 Claims, 3 Drawing Sheets

U.S. PATENT DOCUMENTS

| | | | | |
|---|---|---|---|---|
| 4,273,383 | A * | 6/1981 | Grisebach | 299/23 |
| 4,341,273 | A | 7/1982 | Walker et al. | |
| 4,372,403 | A | 2/1983 | Beeman | |
| 4,417,379 | A | 11/1983 | Goode | |
| 4,527,637 | A | 7/1985 | Bodine | |
| 4,796,713 | A | 1/1989 | Bechem et al. | |
| 4,838,615 | A * | 6/1989 | Oldham | 299/73 |
| 5,103,705 | A | 4/1992 | Bechem | |
| 5,221,122 | A * | 6/1993 | Mraz | 299/57 |
| 5,575,537 | A | 11/1996 | Kogler et al. | |
| 6,062,650 | A | 5/2000 | Smith et al. | |
| 6,076,895 | A | 6/2000 | Ino et al. | |
| 6,357,831 | B1 | 3/2002 | Stoebe | |
| 6,561,590 | B2 * | 5/2003 | Sugden | 299/71 |

FOREIGN PATENT DOCUMENTS

| | | | |
|---|---|---|---|
| AU | 41965/72 | | 12/1973 |
| CA | 2080828 | | 4/1991 |
| DE | 33 13 435 | A1 | 10/1984 |
| DE | 3316840 | A1 * | 11/1984 |
| DE | 3328163 | A1 * | 2/1985 |
| DE | 4015492 | | 11/1991 |
| DE | 4332113 | | 3/1995 |
| DE | 44 40498 | A1 | 8/1995 |
| DE | 197 40 078 | A1 | 3/1999 |
| EP | 0040078 | | 11/1981 |
| EP | 0692 612 | A2 | 1/1996 |
| GB | 2 124 407 | A | 2/1984 |
| GB | 2 136 479 | A | 9/1984 |
| GB | 2 197 010 | A | 5/1988 |
| GB | 2 252 576 | A | 8/1992 |
| RU | 582163 | | 11/1977 |
| RU | 714008 | | 2/1980 |
| RU | 1084-438 | A | 1/1983 |
| RU | 1263841 | | 10/1986 |
| WO | WO91/18185 | | 11/1991 |
| WO | WO 00/43637 | | 7/2000 |
| WO | WO 00/46486 | | 8/2000 |
| WO | WO 02/01045 | | 1/2002 |

OTHER PUBLICATIONS

Stack B, "Encyclopedia of Mining, Tunnelling and Drilling Equipment", 11 pages, Muden Publishing Company, Hobart.

Reference Materials Describing and/or Showing Rolling Type Cutters and Other Cutter, 7 pages.

EPO Communication dated Mar. 16, 2006 and Supplementary European Search Report.

* cited by examiner

ROCK CUTTING MACHINE

CROSS REFERENCE TO PRIORITY APPLICATIONS

This application is the U.S. National Phase of International Application No. PCT/AU03/00474, filed in Australia on 22 Apr., 2003, which designated the U.S., and claims priority to Australian Application No. PS 1869, filed 22 Apr. 2002, each incorporated by reference in its entirety.

FIELD OF THE INVENTION

This invention relates to a rock cutting machine and has been devised particularly, though not solely for mining rock faces.

BACKGROUND OF THE INVENTION

This invention is a development of the oscillating disc cutter constructions described in international patent applications PCT/AU00/00030 and PCT/AU00/00066, the contents of which are incorporated herein by way of cross reference. Reference to these two international patent specifications should not be regarded as an admission that the constructions shown in these specifications form part of the common general knowledge in Australia or anywhere else in the world.

It is desirable to provide an oscillating disc cutter, which has advantages over previously known roller cutters for all of the reasons mentioned in the aforementioned international patent specifications, which is also economical to operate due to factors such as reduced power consumption or reduced wear on the cutter disc.

It is an object of the present invention to overcome or ameliorate at least one of the disadvantages of the prior art, or to provide a useful alternative.

SUMMARY OF THE INVENTION

The present invention therefore provides a rock cutting machine including:

a boom rotatably mounted at a proximal end to a chassis adapted to be placed adjacent a rock face to be cut such that the boom extends from the chassis to a distal end adjacent the rock face, the boom having a longitudinal boom axis extending between the proximal and the distal ends, and a cutting device having a longitudinal axis and being pivotally mounted to the boom about a pivot axis at or adjacent the distal end of the boom and caused to pivot in use about the pivot axis by a drive mechanism, the pivot axis being offset from the longitudinal axis of the cutting device.

Preferably, the cutting device is an oscillating disc cutter and the longitudinal axis of the cutting device is collinear with the axis of oscillation of the disc.

Preferably, the pivot axis is offset from the longitudinal axis of the cutting device by a distance sufficient to cause the cutting disc on the oscillating disc cutter to withdraw slightly from the rock face in use during pivoting of the oscillating disc cutter about the pivot axis.

Preferably, the longitudinal axis of the cutting device is adjustable with respect to the pivot axis.

Preferably, the longitudinal axis of the cutting device is laterally adjustable from a position on a first side of the pivot axis to a position on an opposing side of the pivot axis.

Preferably, the boom is rotatably mounted to the chassis about mutually orthogonal rotation axes.

Preferably, the rotation axes are vertical and horizontal when the chassis is on a level surface.

Preferably, the boom is also rotatable about the longitudinal boom axis, allowing the orientation of the offset to be altered in use relative to the rock face.

BRIEF DESCRIPTION OF THE DRAWINGS

A preferred embodiment of the invention will now be described, by way of example only, with reference to the accompanying drawings in which.

DETAILED DESCRIPTION OF THE INVENTION

Figure 1:
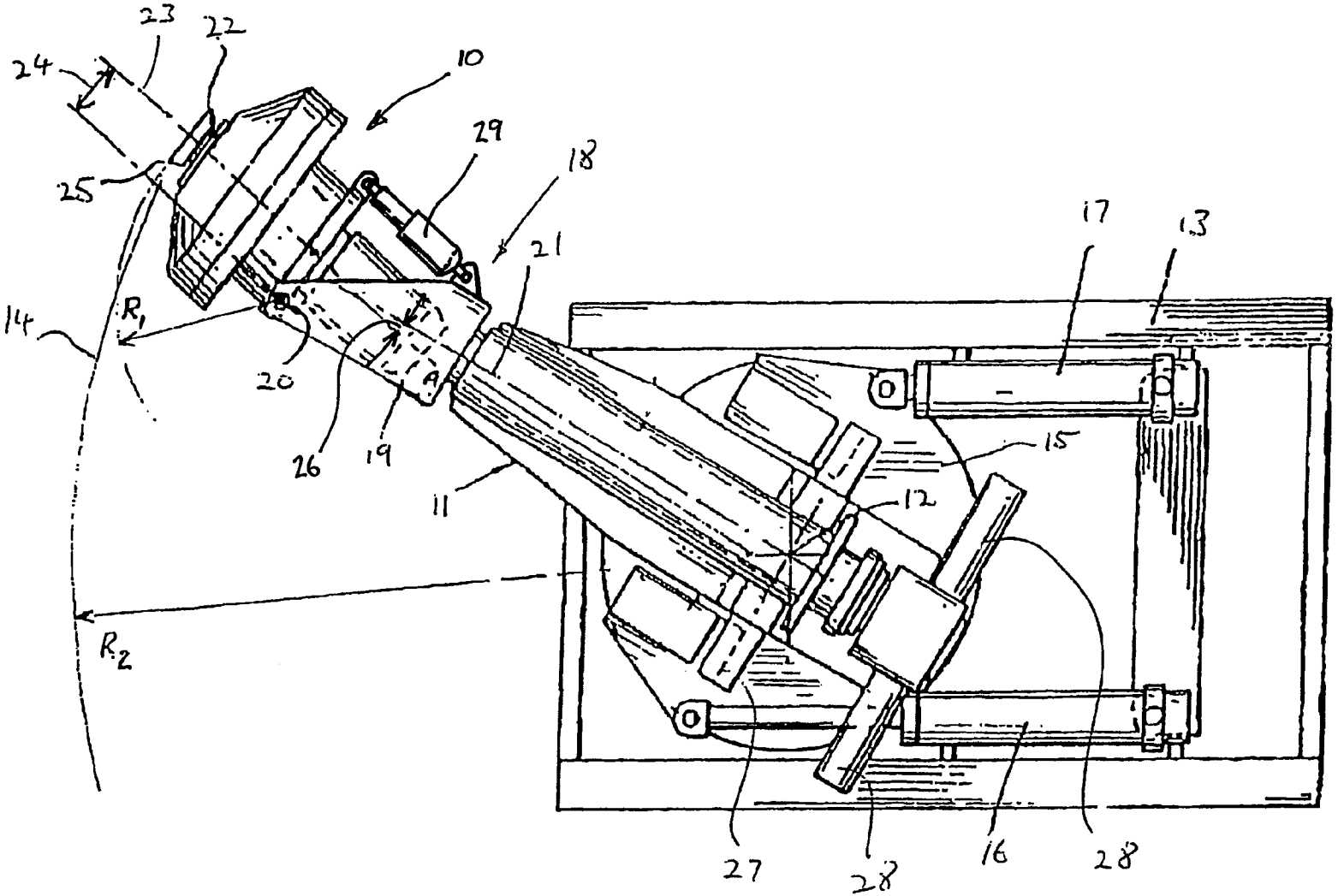
FIG. 1 is a plan view of a rock cutting machine according to the invention.

Referring to the drawings, a cutting device 10 of the type generally described in international patent specification PCT/AU00/00030 is mounted on a boom 11 which in turn is rotatably mounted about a vertical rotation axis 12 to a chassis 13 adapted to be placed adjacent a rock face 14 to be cut. The boom 11 is typically mounted on a turntable 15 and rotated about the vertical rotation axis 12 by operation of piston and cylinder assemblies 16 and 17.

The boom is also rotatable about a horizontal axis 27 to control the elevation of the cutting device 10, and is rotatable about the longitudinal axis 21 of the boom by piston and cylinder assemblies 28.

The distal end 18 of the boom 11 is provided with a mounting yolk 19 incorporating bearings arranged to rotatably support a mounting pin or the like and forming a pivot axis 20 about which the cutting device 10 can pivot relative to the longitudinal axis 21 of the boom 11.

The cutting device 10 has a cutting disc 22 engageable with the rock face 14 and has an axis 23 about which the cutting disc oscillates. Although the cutting device 10 is of the type generally described in PCT/AU00/00030, it will be appreciated that various types of similar cutting devices may be used, with or without the nutating feature described in that patent specification.

The pivot axis 20 is offset from the axis 23 by a distance 24. With this arrangement, the edge 25 of the disc cutter 22 that is actively engaging the rock face 14 is pivoting about the pivot axis 20 at a radius R1. The forces acting on the leading edge 25 of the cutter 22, have components both parallel to axis 23 and perpendicular thereto, tending to cause the angle 26 between the axis 23 of the cutter shaft and the longitudinal axis 21 of the boom 11, to increase.

These forces are typically reacted by one or more hydraulic cylinders 29. The hydraulic cylinders also provide for actuation of the cutter about the pivot axis 20.

As a result of the offset of pivot axis 20 from cutting disc axis 23, the effect of any increase in angle 26 is to cause the cutter to withdraw slightly from the face 14 and thereby to relieve the forces acting, when hard material is encountered.

The offset also results in a change of the angle of the cutting edge of cutting disc 22 relative to the face 14 which has the effect of preserving the sharpness of the cutting edge.

By rotating the boom about longitudinal axis 21 by operation of piston and cylinder devices 28, the effect of the offset may be realised in any desired plane of operation, allowing the aforesaid benefits to be optimised and controlled for various operating sweeps of the boom about either the vertical axis of rotation 12 or the horizontal axis of rotation 27, or combinations of both.

Figure 2:
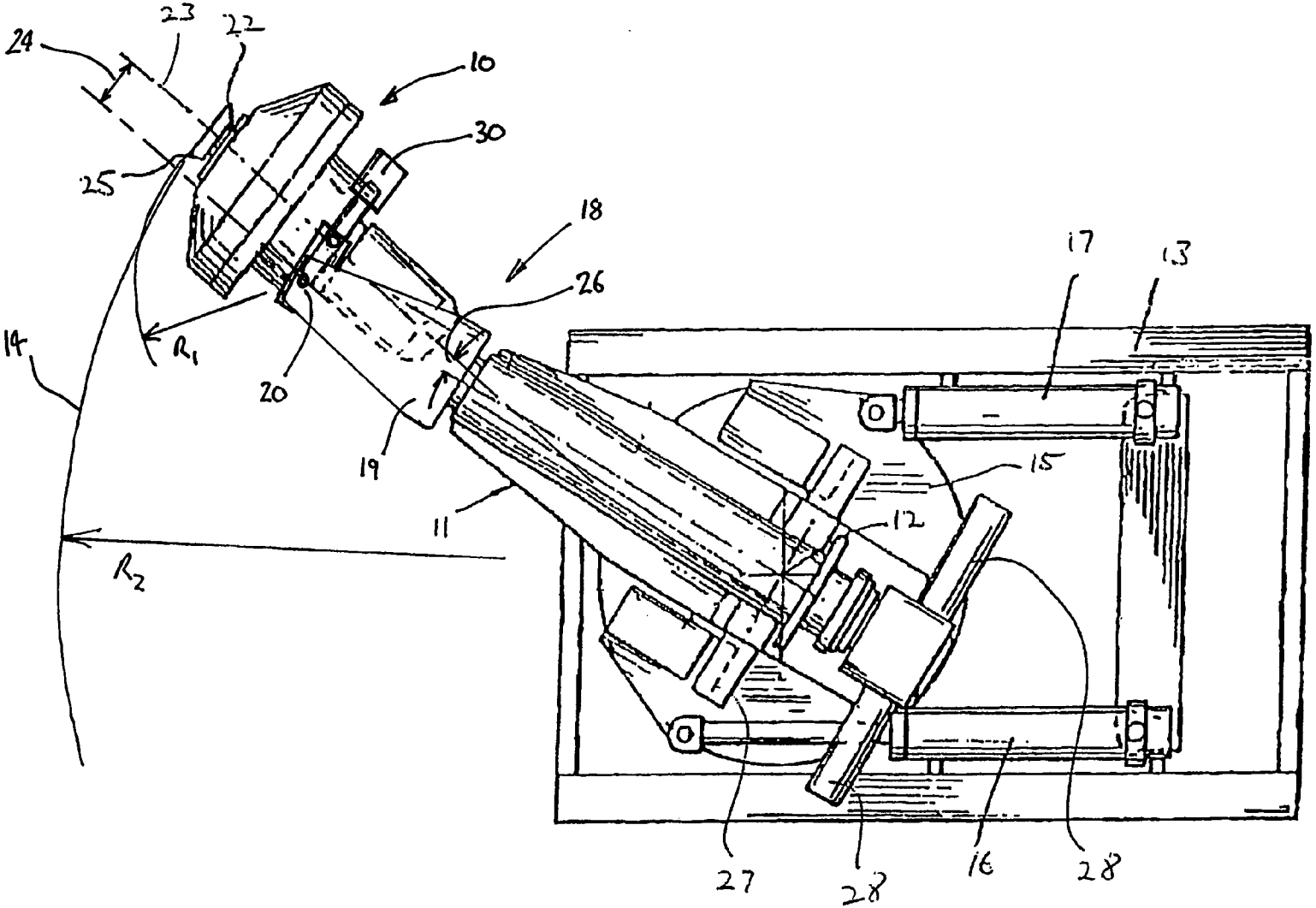
FIG. 2 is a plan view of an alternative embodiment of a rock cutting machine according to the invention.

A modification to the invention is shown in FIG. 2 in which like numbers refer to like parts as shown in the preceding description of FIG. 1. In this embodiment, the cutting device is laterally movable, with respect to the arm axis 21 and yoke 19. In this way, the offset of the pivot axis 21 is achieved with a symmetrical mounting yoke 19 in comparison to that shown in FIG. 1.

The lateral movement may be effected in a number of ways including eccentric cams, sliders or tracks mounted to either the cutting device, the yoke or an intermediate part. FIG. 2 shows a hydraulically operated slider 30.

Figure 3:
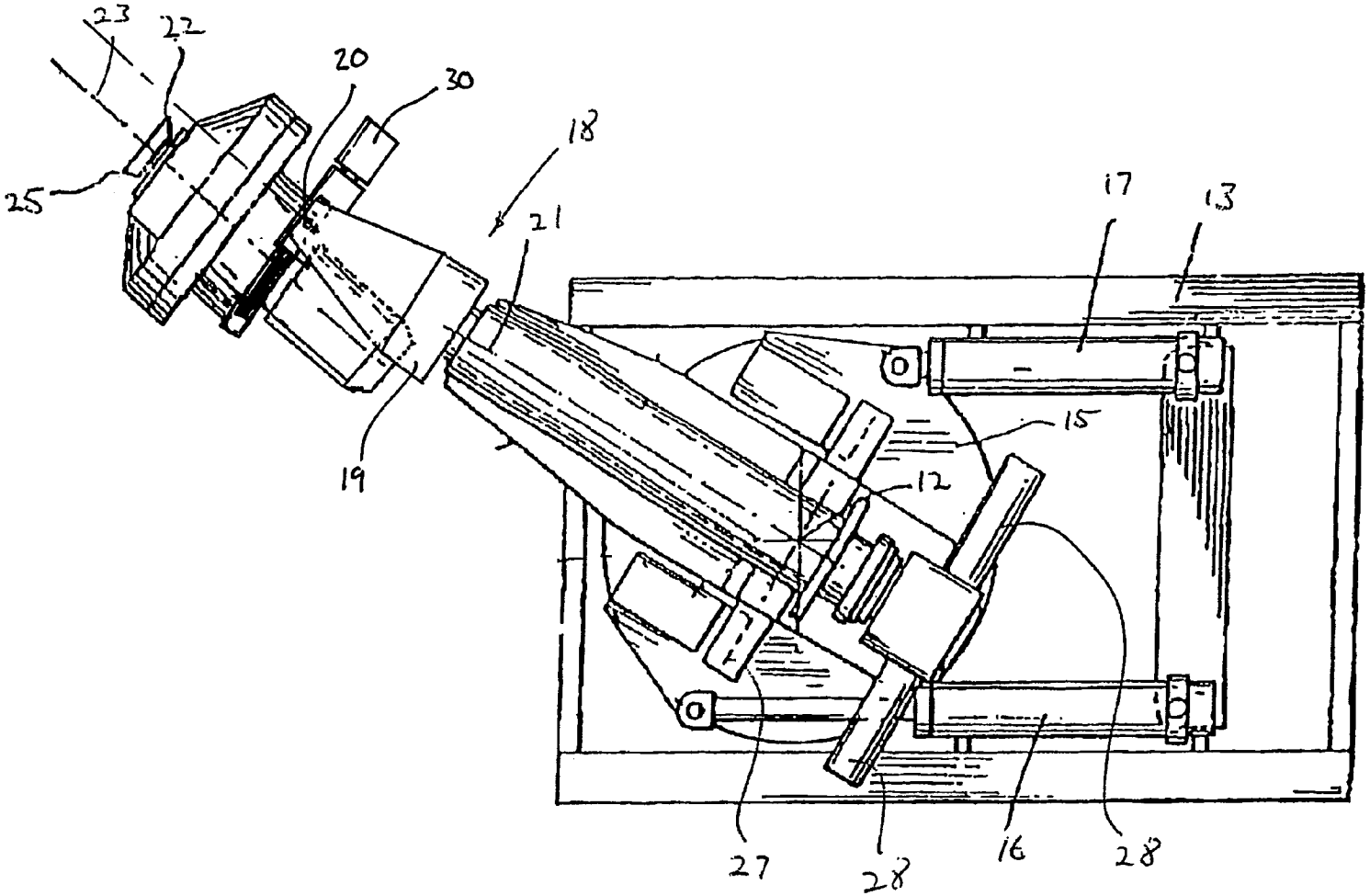
FIG. 3 is another plan view of the embodiment shown in FIG. 2.

The lateral movement allows the pivot axis 20 to be set on either side of the cutting disc axis, as can be seen by comparing FIGS. 2 and 3. By positioning the axis in the required position, the cutting device may be operated in bi-directional sweeps across the rock face without the need to rotate the entire cutting device around axis 21 as is required with the embodiment shown in FIG. 1. Advantageously, this functionality reduces the time between sweeps thereby increasing efficiency.

It will be appreciated that if the pivot axis 20 intersects with the cutter axis 23 (as was previously the case in the construction described in international patent specification PCT/AU00/00030), then when operating with the angle 26 close to zero, the radius R1 to the leading edge of the cutter is greater than the radius measured along the axis 23 and so there is a tendency for the leading edge to dig in to the rock face resulting in a detrimental effect on the life of the cutter. This disadvantage is obviated by offsetting the pivot axis 20 from the cutter axis 23.

In this manner, the life of the cutting disc is prolonged due to the relief in the forces acting between the cutting disc and the rock face when hard material is encountered.

Although the invention has been described with reference to specific examples it will be appreciated by those skilled in the art that the invention may be embodied in many other forms.

The invention claimed is:

1. A rock cutting machine including:

a boom rotatably mounted at a proximal end to a chassis adapted to be placed adjacent a rock face to be cut such that the boom extends from the chassis to a distal end adjacent the rock face, the boom having a longitudinal boom axis extending between the proximal and the distal ends, and a cutting device including an oscillating disc cutter, said cutter having an oscillation axis, said device being pivotally mounted to the boom about a pivot axis at or adjacent the distal end of the boom and caused to pivot in use about the pivot axis by a drive mechanism, the pivot axis being offset from the longitudinal oscillation axis of the cutting device, wherein the pivot axis is offset from the oscillation axis of the cutting device by a distance sufficient to cause a cutting disc on the oscillating disc cutter to withdraw slightly from the rock face in use during pivoting of the device about the pivot axis.

2. A rock cutting machine according claim 1, wherein the pivot axis is adjustable with respect to the oscillation axis of the cutting device.

3. A rock cutting machine according to claim 1, wherein the oscillation axis of the cutting device is laterally adjustable from a position on a first side of the pivot axis to a position on an opposing side of the pivot axis.

4. A rock cutting machine according to claim 1, wherein the boom is rotatably mounted to the chassis about mutually orthogonal rotation axes.

5. A rock cutting machine according to claim 4, wherein the rotation axes are vertical and horizontal when the chassis is on a level surface.

6. A rock cutting machine according to claim 1 wherein the boom is also rotatable about the longitudinal boom axis, allowing the orientation of the offset to be altered in use relative to the rock face.

7. A rock cutting machine according to claim 1, wherein the pivot axis precedes the oscillation axis relative to a given cutting direction such that under the influence of cutting reaction forces, the device will be caused to pivot about the pivot axis in a direction opposite to the cutting direction.

8. A rock cutting machine including:

a boom rotatably mounted at a proximal end to a chassis adapted to be placed adjacent a rock face to be cut such that the boom extends from the chassis to a distal end adjacent the rock face, the boom having a longitudinal boom axis extending between the proximal and the distal ends, and a cutting device including a longitudinal axis and being pivotally mounted to the boom about a pivot axis at or adjacent the distal end of the boom and caused to pivot in use about the pivot axis by a drive mechanism, the pivot axis being offset from the longitudinal axis of the cutting device, wherein the pivot axis precedes the longitudinal axis relative to a given cutting direction such that under the influence of cutting reaction forces, the device will be caused to pivot about the pivot axis in a direction opposite to the cutting direction, and wherein the pivot axis is offset from the longitudinal axis of the cutting device by a distance sufficient to cause a cutting disc on the cutting device to withdraw slightly from the rock face in use during pivoting of the cutting device about the pivot axis.

9. A rock cutting machine according to claim 8, wherein the longitudinal axis of the cutting device is adjustable with respect to the pivot axis of the cutting device.

10. A rock cutting machine according to claim 8, wherein the longitudinal axis of the cutting device is laterally adjustable from a position on a first side of the pivot axis to a position on an opposing side of the pivot axis.

11. A rock cutting machine according to claim 8, wherein the boom is rotatably mounted to the chassis about mutually orthogonal rotation axes.

12. A rock cutting machine according to claim 11, wherein the rotation axes are vertical and horizontal when the chassis is on a level surface.

13. A rock cutting machine according to claim 8, wherein the boom is also rotatable about the longitudinal boom axis, allowing the orientation of the offset to be altered in use relative to the rock face.

14. A rock cutting machine including:

a boom rotatably mounted at a proximal end to a chassis adapted to be placed adjacent a rock face to be cut such that the boom extends from the chassis to a distal end adjacent the rock face, the boom having a longitudinal boom axis extending between the proximal and the distal ends, and a cutting device including an oscillating disc cutter, said cutter having an oscillation axis and being pivotally mounted to the boom about a pivot axis at or adjacent the distal end of the boom and caused to pivot in use about the pivot axis by a drive mechanism, the pivot axis being offset from the oscillation axis of the cutting device, wherein the boom is configured to move or sweep along an arc in a first direction and the disc cutter is configured to pivot about the pivot axis in a second direction that is opposite the first direction when a leading edge of the disc cutter encounters hard material.

15. A rock cutting machine according to claim 14 wherein the pivot axis precedes the oscillation axis relative to a given cutting direction such that under the influence of cutting reaction forces, the device will be caused to pivot about the pivot axis in a direction opposite to the cutting direction.

16. A rock cutting machine according to claim 14 wherein the cutter is mounted on a yoke.

17. A rock cutting machine according to claim 16 wherein the pivot axis is configured to move relative to the yoke.

* * * * *